US005480332A

United States Patent [19]

Cynamon

[11] Patent Number: 5,480,332

[45] Date of Patent: Jan. 2, 1996

[54] MULTIPLE VICTIM RESCUE DEVICE

[76] Inventor: Sam Cynamon, 517 Wyoming Ave., Millburn, N.J. 07041

[21] Appl. No.: 232,691

[22] Filed: Apr. 25, 1994

[51] Int. Cl.[6] ..... B63C 9/26

[52] U.S. Cl. ..... 441/80; 441/84; 441/88

[58] Field of Search ..... 441/80, 84, 88, 441/108, 129; 114/343

[56] References Cited

U.S. PATENT DOCUMENTS

| | | | |
|---|---|---|---|
| 815,394 | 3/1906 | Wikstrom . | |
| 1,026,519 | 5/1912 | Knoph . | |
| 1,184,325 | 5/1916 | Coxey . | |
| 1,289,123 | 12/1918 | Decowski . | |
| 1,403,362 | 1/1922 | Walters | 441/84 |
| 2,050,138 | 4/1936 | Walters . | |
| 3,181,184 | 5/1965 | Potts | 441/108 |
| 3,370,818 | 2/1968 | Perr | 114/343 |
| 3,416,172 | 12/1968 | Gerling . | |
| 4,138,753 | 2/1979 | Wood | 441/129 |
| 4,538,899 | 9/1985 | Hölzel | 441/122 |
| 4,889,511 | 12/1989 | Herman | 441/88 |
| 4,929,205 | 5/1990 | Jones | 441/60 |
| 5,102,360 | 4/1992 | Eycleshimer | 441/80 |
| 5,292,273 | 3/1994 | Giessl | 441/123 |

*Primary Examiner*—Sherman Basinger
*Attorney, Agent, or Firm*—Klaus P. Stoffel

[57] ABSTRACT

A multiple victim rescue device made of at least three elongate buoyant members each having two ends and at least one planar outer surface. The elongate members can be connected together at their outer planar surface so that one of the elongate members is arranged centrally between the remaining members. A tow line is fixed to one end of the central member and the other end of the central member as well as the ends of the remaining members are provided with either hooks or rings so that the ends can be connected together.

11 Claims, 3 Drawing Sheets

MULTIPLE VICTIM RESCUE DEVICE

BACKGROUND OF THE INVENTION

The present invention relates to a floatation device for use in life saving, and more particularly to a device which permits rescuing more than one person at a time.

A number of different types of rescue devices are known, and these include a life vest, a floating ring or life preserver, and a so-called rescue tube or can (see FIG. 7). Although each of these devices work to a certain degree, they also have several drawbacks. Namely, the life vest and the life preserver are generally intended for use by a single person.

At a beach or a pool, normally when a swimmer begins to have difficulties a lifeguard swims out to the individual with a floatation device of some sort, such as a ring or a foam cylinder. The drowning victim then grabs the rescue device and is towed in by the lifeguard.

However, a problem arises, which to date has found no suitable solution, when more than one individual needs assistance at the same time. Previously, a rescuer would have to make a determination as to which person would be rescued first. This decision is normally made based upon the rescuer's determination as to which person is in the greatest distress and which persons might be able to hold out until further help arrives. The obvious problem with such a situation is that there is the risk that not all of the individuals can be rescued.

The prior art has provided a device intended for use in multi-person rescues. This device is basically a hard plastic bullet-shaped device with handles on its side and a tow rope at its tip, as shown in FIG. 7. It is intended that the victims grab onto the handles and then be towed in by a rescuer. The problem with this prior art device is that it is made of a hard material which can cause injury to both the victim and the rescuer, and additionally the device requires that the victim hold onto it in order to be rescued. This is clearly a problem when the victim has either lost consciousness or is acting hysterically, as is often the case in a water rescue.

SUMMARY OF THE INVENTION

Accordingly, it is an object of the present invention to provide a rescue device which permits the rescue of multiple individuals without the problems associated with the prior art.

Pursuant to this object, and others which will become apparent hereafter, one aspect of the present invention resides in a multiple victim rescue device having a soft main elongate member with a buoyancy sufficient to support at least one person. The main member is made of a flexible material that has a soft outer surface to help prevent injury. Also, the main member has two ends and at least two fiat sides. Additionally, smaller buoyant elongate members are releasably attached to the flat sides of the main member. Each of these additional members is also of a sufficient buoyancy to support at least a single person. One end of the main member has a tow rope fixed to it so as to permit a rescuer to tow the device. The additional members each have a hook on one end and a ring on another end. Furthermore, the main member has a hook on its end opposite the tow line. The hook and ring of each member are connected together by a strap or cord that runs longitudinally and internally through the center of the member.

When fastened together, tier example by a hook and loop fastener such a Velcro®, the buoyant members form a single unit with a shape which facilitates towing of the unit in water. Upon reaching multiple victims the rescuer can remove the additional members from the main member and can wrap each additional member around a victim and clip the opposing ends together to form a buoyant ring. The same can be done with the main member. Thus, it is possible to provide assistance to all three victims.

It is also possible to provide the main member with a different cross section, i.e. a triangular or octagonal cross section, which makes it possible to attach more than two additional buoyant members thereto. Any symmetrical shape of the members is acceptable so long as, when assembled, an overall streamlined structure results which makes it easy to tow the unit in water.

The unique construction of the inventive apparatus allows the members to be connected in various manners to facilitate a rescue operation. For example, one of the members can be wrapped around the victim and clipped together while the remaining members are clipped end to end and then clipped to the member wrapped around the victim. In this way the tow line is extended and additional flotation is provided near the victim.

Furthermore, one of the members can be wrapped around a victim while another of the members can be used by the rescuer as a support that permits the rescuer to provide artificial respiration to a victim, if necessary.

The inventive apparatus can also be used to execute rescues where an individual has broken through ice and cannot be reached by others due to the thickness of the ice. By connecting the elongate elements end to end is possible to push them over the top of the ice to the victim.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing.

FIGS. *7a–7b* show various possible cross sections of the members shown in FIG. 2.

DETAILED DESCRIPTION OF THE PREFERRED EMBODIMENTS

Figure 1:
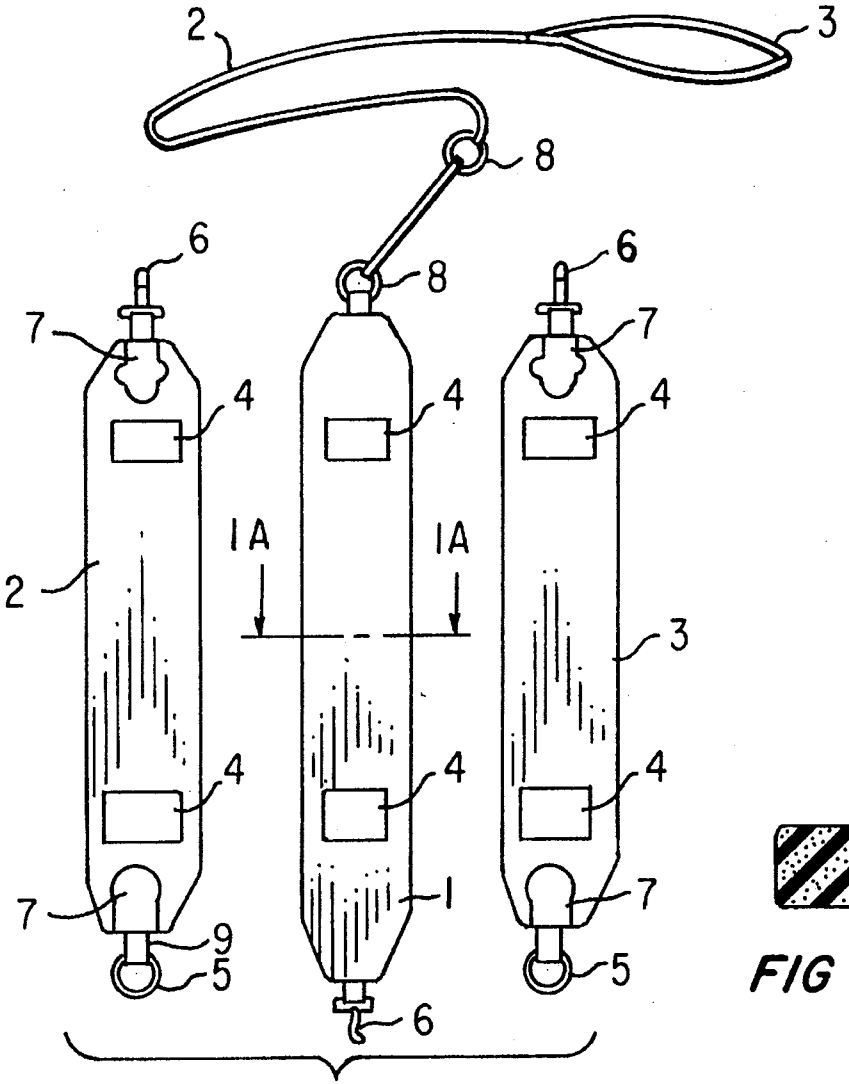
FIG. 1 shows the inventive device in a disassembled state.
Figure 1A:
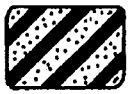
FIG. 1A is a cross-reference along line A—A in FIG. 1.
Figure 2:
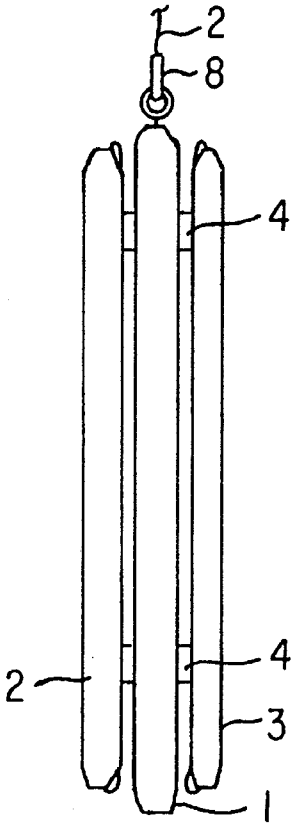
FIG. 2 shows the components of FIG. 1 in an assembled state.
Figure 5:
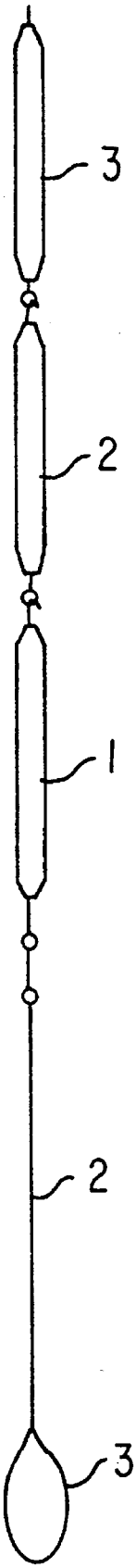
FIG. 5 schematically shows the members of FIG. 1 connected end to end.
Figure 6:
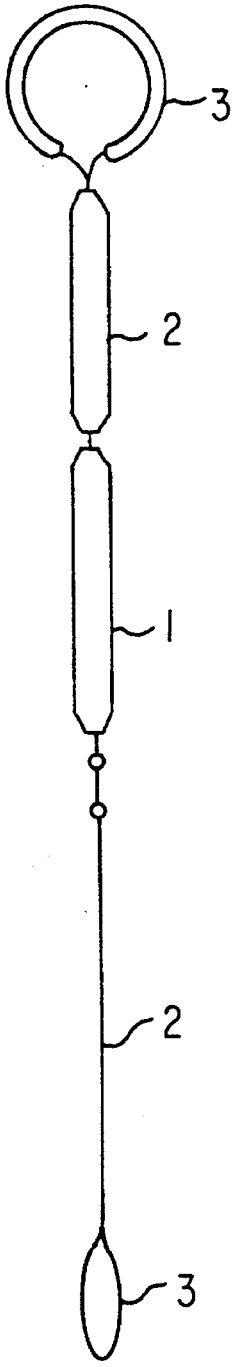
FIG. 6 schematically shows a different possible connection of the members.
Figure 8:
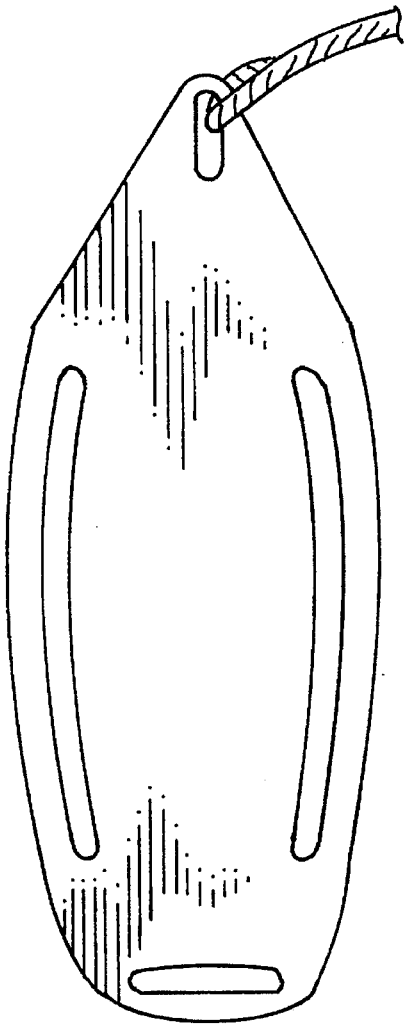
FIG. 8 PRIOR ART
FIG. 8 shows a prior art rescue device.

As seen in FIGS. 1 and 2, the inventive apparatus is comprised of a central elongate member 1 made of a vinyl coated closed-cell foam material. At one end of the central member 1, a tow rope 2 with a harness 3 is connected so as to permit a rescuer to wrap the harness around his body and pull the central member 1. A pair of side members 2, 3, made of the same material as the central member 1, are releasably attached to the central member 1 by a hook and loop fastener 4, such as Velcro®. One end of each side member 2, 3 is provided with a ring 5 while the other end of each member 2, 3 is provided with a hook or clip 6. The end of the central member 1 opposite the tow rope 2 is also provided with a clip 6. A cord or strap 9 runs longitudinally through the center of each member to connect together the ring and hook of the member and allow other members to be connected thereto for the purpose of towing, as shown in FIGS. 5 and 6.

Figure 3:
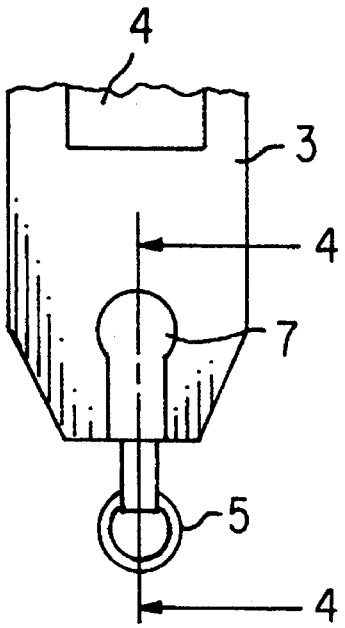
FIG. 3 shows an enlarged portion of one end of one of the elongate members.
Figure 4:
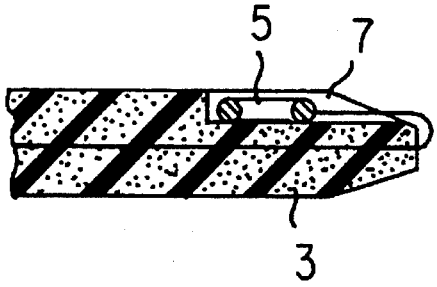
FIG. 4 shows a cross-section of FIG. 3.

Each of the buoyant members has, in end regions near the rings 5 and hooks 6, recesses 7 molded into the body of the members so as to accommodate the rings 5 and hooks 6, as shown in FIGS. 3 and 4. The rings and hooks 5, 6 permit the members 1–3 to be attached end to end or to individually form a ring, as schematically shown in FIGS. 5 and 6. The tow line 2 can also have rings 8 arranged therein to allow the main member 1 to form a ring. The recesses can also be in the ends of the members so that the cord 9 runs out of the recess. The hook or ring can be manually pushed into the recess on the end of the member or spring means can be provided to automatically retract the hook or ring into the recess.

Although a hook and loop fastening means is described above as the preferred embodiment, it is understood that any releasable fastening means, i.e. snaps, can be used to connect together the members 1–3. In the same vein, although rings and hooks or clips are shown at the ends of the members, it is also possible to utilize for example a buckle. It is also possible to completely delete the hooks and rings or buckles on the side members so that the side members are usable only individually as flotation devices once removed from the central member.

Figure 7A:
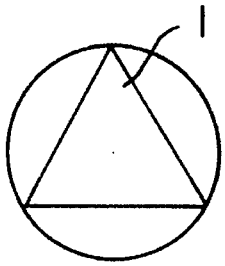

In the embodiment shown in FIG. 1, the members 1–3 each have a rectangular cross-section. The flat outer surfaces of the members serve as engagement surfaces on which the hook and loop fasteners 4 are provided. It is, however, also possible to provide the members with other types of cross sections. For example, as shown in FIG. 7*a*, the central member 1 can have a triangular cross section and three side members having a partial circular cross section can be attached to the main member.

Figure 7B:
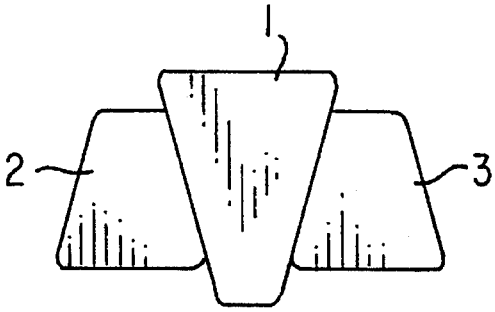

The members can also have other complimentary cross-sections, as shown in FIG. 7*b*.

The invention is not limited by the embodiments described above which are presented as examples only but can be modified in various ways within the scope of protection defined by the appended patent claims.

I claim:

1. A multiple victim rescue flotation device, comprising: at least three elongate resilient buoyant members each having two ends and a peripheral surface with at least one planar outer surface portion; first connecting means provided on the at least one planar surface portion of each of said members for releasably connecting together said members so that when connected together the members form a single flotation unit in which one of said members is centrally arranged and the remaining members are releasably connected to the peripheral surface of the central member whereby the first connecting means permits the elongate members to be disconnected to provide flotation for multiple victims; a tow line fixed to one end of the central member; and second connecting means for releasably connecting said members together end to end and for releasably connecting together both ends of a single one of said members.

2. A rescue device as defined in claim 1, wherein the tow line has rings arranged along its length.

3. A rescue device as defined in claim 1, wherein the first connecting means includes hook and loop fastening means.

4. A rescue device as defined in claim 1, wherein the tow line has a distal end at which a harness is provided.

5. A rescue device as defined in claim 1, wherein the second connecting means includes a hook provided on one end of each elongate member and a ring on the other end of each elongate member.

6. A rescue device as defined in claim 1, wherein each of the elongate members has a recess in a region near the end of the member, said recess being shaped so as to accommodate and hold elements of the second connecting means.

7. A rescue device as defined in claim 1, wherein the elongate members are made of a vinyl-coated closed-cell foam.

8. A rescue device as defined in claim 1, wherein the elongate members have a rectangular cross section.

9. A rescue device as defined in claim 1, wherein four elongate members are provided, the centrally arranged member having a triangular cross section and the remaining members having a semi-circular cross section so that when the semi-circular members are connected to the triangular member an overall circular cross section is formed.

10. A rescue device as defined in claim 1, wherein the central member has at least two planar surface portions.

11. A rescue device as defined in claim 1, wherein the central member has a number of planar surface portions equal to a number of elongate members connectable to the peripheral surface of the central member.

* * * * *